United States Patent [19]

Abel

[11] 4,286,632

[45] Sep. 1, 1981

[54] FUEL-LUBRICATING OIL PROPORTIONER AND MIXER

[75] Inventor: Donald J. Abel, Bradenton, Fla.

[73] Assignee: David Albert, Tampa, Fla.

[21] Appl. No.: 76,946

[22] Filed: Sep. 19, 1979

[51] Int. Cl.[3] ..... B65B 3/02

[52] U.S. Cl. ..... 141/18; 222/22; 222/159; 222/205

[58] Field of Search ..... 141/18, 100; 222/159, 222/205, 22; 137/2, 9, 250–284, 101.31, 101–113, 115–122, 114

[56] References Cited

U.S. PATENT DOCUMENTS 2,535,204 12/1950 Hageline ..... 222/159

*Primary Examiner*—Houston S. Bell, Jr.

[57] ABSTRACT

A fuel-lubricating oil proportioning and mixing device for mixing an appropriate quantity of lubricating oil with an appropriate quantity of fuel in the fuel tank of an internal combustion engine, principally for motor boats powered by two-cycle engines. The device of the invention comprises a lubricating oil reservoir separate from the fuel tank and a graduated measuring container connected to the oil reservoir through a solenoid actuated two-position valve and a reversible pump. The oil measuring container is connected to the fuel tank filler through the pump, the valve and a discharge line. After a known quantity of fuel has been taken in the fuel tank, the pump is actuated to draw from the oil reservoir through the valve an appropriate proportional quantity of oil into the measuring container. After a desired quantity of lubricating oil has been pumped into the measuring container, the pump is reversed while the valve is simultaneously activated to be disconnected from the lubricating oil reservoir and connected the fuel tank oil discharge line to discharge the measured quantity of lubricating oil into the fuel tank.

8 Claims, 3 Drawing Figures

FUEL-LUBRICATING OIL PROPORTIONER AND MIXER

BACKGROUND OF THE INVENTION

The present invention relates to a fuel-lubricating oil proportioning and mixing device, more particularly for use on a boat powered by internal combustion engine of the two-cycle type using a mixture of fuel and lubricating oil, for withdrawing from a lubricating oil reservoir a predetermined quantity of lubricating oil required to be mixed with a given quantity of fuel.

Dry sump internal combustion engines, such as two-cycle engines, require a fuel-oil mixture to be supplied to the engine when the engine is operated. In some installations, as is often the case for motorcycles, a variable discharge oil pump supplies a measured flow of lubricating oil from a separate reservoir into the carburetor inlet, the oil being automatically mixed with the fuel atomized in the carburetor. The pump is controlled so as to supply a variable flow of lubricating oil as a function of the throttle opening. Lubricating systems of this type present many inconveniences, such as requiring a separate oil injection pump which is subject to deterioration, wear and malfunction, the discharge rate of which must be calibrated with precision so as to supply neither too much nor too little lubricating oil at every throttle opening.

In other installations, wherein a mixture of fuel and lubricating oil is drawn directly from the fuel tank by gravity or by the engine fuel pump, a measured quantity of lubricating oil must be poured into the fuel tank every time the fuel tank is refilled with a known quantity of fuel. Although, with present-day lubricating oil compounded for mixing with fuel, such as gasoline, effective mixing of the oil with the gasoline requires no stirring in view of the fact that the oil is readily dissolved by the gasoline, such a task of pouring a proportionate amount of lubricating oil into the fuel tank may easily be overlooked, is time-consuming, unpleasant, and delicate to effectuate with precision when the oil is obtained from small capacity cans. To mix a proper proportion of lubricating oil with a given quantity of fuel in the fuel tank of high power two-cycle engines, of the type presently used in high speed power boats, is particularly important as too much oil in the fuel may lead to excessive smoke in the exhaust and fouling of the spark plugs, while insufficient lubricating oil, or complete lack of oil, will immediately result in damaging or completely wrecking a very expensive engine. Fast modern power boats are often powered by a pair, or even by three or four, two-hundred or more horsepower outboard engines which draw a fuel-oil mixture from a large capacity fuel tank mounted at a convenient location in the hull of the boat. When several hundred gallons of fuel are taken in during refueling, the task of pouring down the fuel tank filter several gallons of lubricating oil is time-consuming, especially in the course of a pit stop while racing, subject to errors as to the quantity of lubricating oil used, and somewhat messy, especially when the lubricating oil is poured from pint and quart cans.

Fuel-lubricating oil mixing devices have been designed in the past, such as disclosed in U.S. Pat. Nos. 2,908,289, 2,926,695 and 4,069,835, for example, which are adapted to automatically measure a predetermined quantity of lubricating oil from a separate reservoir, or a separate compartment in the fuel tank, and automatically mix the lubricant with the fuel as a function of the amount of fuel poured into the fuel tank, sometimes during the refueling operation itself. Such automatic mixing devices may on first glance appear to be convenient but, like any other mechanical devices, they are subject to deterioration and malfunction, more particularly if they fail to discharge into the fuel tank a sufficient quantity of lubricating oil, or if the lubricating oil reservoir has run dry.

SUMMARY OF THE PRESENT INVENTION

The present invention provides a manually controllable lubricating oil proportioner and mixer capable of pumping lubricating oil from a separate lubricating oil reservoir into a graduated container providing a visible level of the quantity of lubricating oil pumped into the container and, by reversing the pump and through the use of an appropriate valving arrangement, pouring into the fuel tank the measured quantity of lubricating oil.

The many objects and advantages of the present invention will become apparent to those skilled in the art when the following description of the best modes contemplated for practicing the invention is read in conjunction with the accompanying drawing wherein:

DETAILED DESCRIPTION OF THE PREFERRED EMBODIMENT

Figure 1:
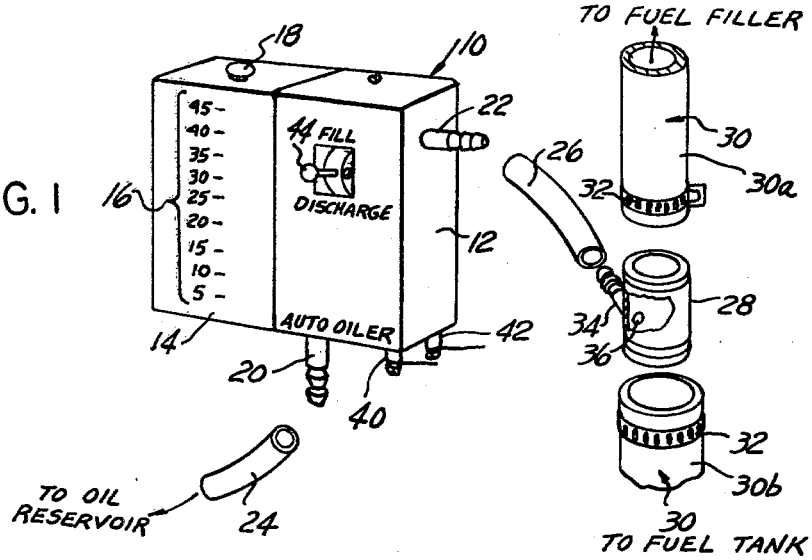
FIG. 1 is a schematic partly exploded view of an example of fuel-lubricating oil proportioner and mixer according to the present invention.

Referring to the drawing, and more particularly to FIG. 1, a fuel-lubricating oil proportioner and mixer 10 according to the present invention, ready for installation in a power boat or the like, takes the form of a housing 12 and of an adjacent container 14 made of, preferably, a transparent plastic and having a face provided with appropriate graduations 16. The top of the container 14 is placed in communication with the ambient by means of an air vent 18, such that the container 14 may be filled with lubricating oil, as will be explained hereinafter, and emptied without hindrance and causing pressure to be applied on the walls of the container. The graduations 16 may be in any appropriate volume designations, such as for example pints, to indicate the volume of liquid in the container 14 when the level of lubricating oil therein reaches a certain graduation or, alternatively and preferably, it may be graduated directly in gallons or liters of fuel, the level of lubricating oil contained in the container 14 thus indicating the appropriate amount of lubricating oil corresponding to a known volume of fuel taken in the fuel tank during fueling.

The housing 12 and the graduated container 14 are provided with appropriate mounting brackets, not shown, for installing at an appropriate location in a boat. An inlet fitting or nipple 20 and a outlet fitting or nipple 22 project from the housing 12. The fitting or nipple 20 is connected through a flexible hose or pipe 24 to an oil reservoir 25, FIG. 2, located at some convenient place in the boat hull, not shown, and by means of a preferably transparent flexible hose or pipe 26 to a fuel filler pipe oil discharge insert 28 disposed in the fuel filler pipe 30. For that purpose, the filler pipe 30 is in two separate sections 30*a* and 30*b*, or is cut into two separate sections, and each end of the lubricating oil discharge insert 28, which is in the form of a tubular member or sleeve, is connected between two filler pipe sections 30*a*, 30*b*, the ends of the pipe sections 30*a* and 30*b* being clamped over each end of the insert 28 by means of a hose clamp 32.

Figure 2:
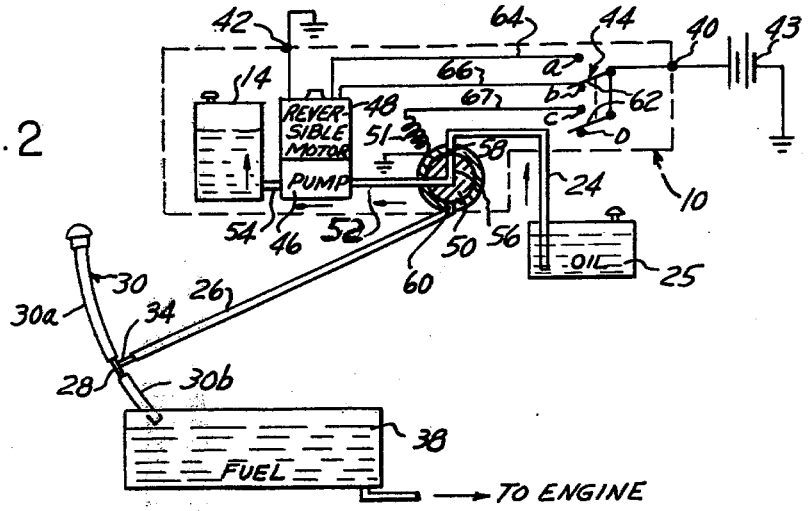
FIG. 2 is a schematic thereof showing pumping a measured quantity of lubricating oil from a lubricating oil reservoir.

The oil discharge insert 28 is laterally provided with a tubular nipple 34 for coupling to the end of the line or hose 26, the nipple 34 terminating within the tubular insert 28 by an orifice 36 permitting oil supplied by the lubricant oil proportioner and mixing device 10 to be discharged into the main fuel tank 38, FIG. 2, where it is thoroughly mixed with the fuel contained therein.

The lubricating oil proportioner and mixer 10 is further provided with a pair of terminals, or binding posts, 40 and 42 for connection across a DC power supply such as the battery 43, FIG. 2, of the boat. A control in the form of a toggle switch 44, projecting from the housing 12, is manually operable from a neutral center position to an up "fill" position for filling the lubricating oil measuring and proportioning container 14 to an appropriate level, and to a down "discharge" position for discharging the measured amount of lubricating oil from the container 14 through the transparent line or hose 26 to the fuel tank 38 through the oil discharge insert 28. Providing the line or hose 26 with at least a transparent section at or proximate to its inlet permits one to visually check that lubricating oil is properly discharged through the line or hose 26 for mixing with the fuel.

The housing 12 acts as a cover for the components of the lubricating oil proportioner and mixer 10, represented schematically at FIG. 2, comprising a reversible pump 46 driven by a reversible electric motor 48 and a two-way valve 50 operated by a solenoid 51. The valve 50 is connected to the pump 46 via a conduit 52, and the pump 46 is connected to the bottom of the container 14 via a conduit 54. The body of the valve 50 has a passageway 56 enabling the conduit 52, between the valve 50 and the pump 46, to be placed in fluid communication with an inlet passageway 58 connected through the pipe or hose 24 to the oil reservoir 25, FIG. 2 or, alternatively, placing the conduit 52 in fluid communication with an outlet 60 connected to the lubricating oil discharge insert 28 via the partially transparent pipe or hose 26. The switch 44, which is a double-pole double-throw switch, has movable contacts 62 connected to a terminal of the battery through the terminal or binding post 40 and four fixed contacts a, b, c, and d. Only three of the fixed contacts of the switch 44 are used, contact a being connected to the reversible electric motor 48 through an electric line 64, contact b being connected via a second line 66 to the motor 48 and contact c being connected to the valve actuating solenoid 51. The switch 44 is operable from a neutral or "off" position to the "fill" position illustrated at FIG. 2, wherein the movable contacts 62 of the switch 44 engage the unconnected fixed contact d and the contact b which places the reversible motor 48 across the battery 43 through the terminals 40 and 42. The motor 48 is thus caused to drive the pump 46 in the appropriate direction drawing lubricating oil from the reservoir 25 through the valve passageway 56 into the transparent measuring and proportioning container 14. The valve 50 normally occupies the position illustrated at FIG. 2 when the solenoid 51 is deactivated, and automatically returned to that position at any time the solenoid 51 is off.

Figure 3:
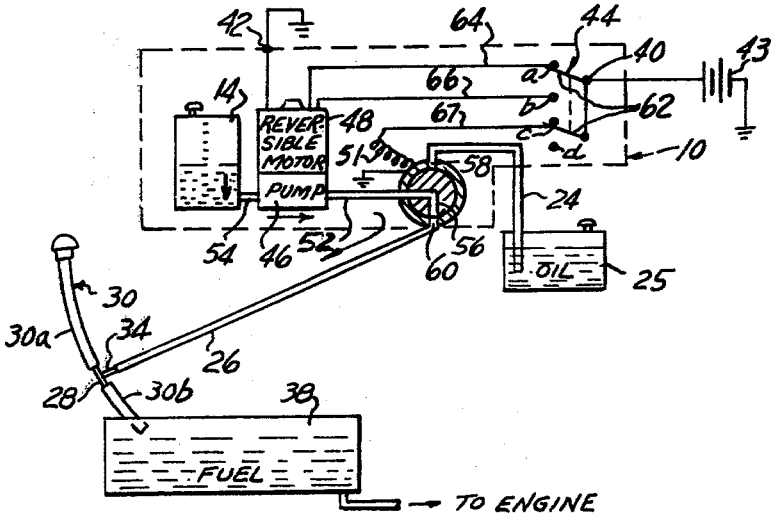
FIG. 3 is a view similar to FIG. 2 but showing the operation of the device of the invention while pouring the measured quantity of lubricating oil into the fuel tank.

After a predetermined proportional amount of lubricating oil has been drawn into the measuring container 14, as a function of the quantity of raw fuel previously poured into the fuel tank 38, the switch 44 is displaced to its "discharge" position, FIG. 3. The switch movable contacts 62 engage the switch fixed contacts a and c, therefore connecting the reversible motor 48 across the battery 43 via line 64, which reverses the direction of rotation of the motor 48, and simultaneously connecting the solenoid 51 across the battery 43 via line 67. Actuation of the solenoid 51 causes the valve 50 to disconnect the oil reservoir 25 from the pump 46 while placing the valve body passageway 56 to the position indicated in FIG. 3 which places the conduit 52 into fluid communication with the outlet 60 of the valve 50. As the flow through the pump 46 is reversed, lubricating oil is drawn from the container 14 through the conduit 52, the valve body passageway 56 and the pipe or hose 26 to the lubricating oil discharge insert 28, such as to discharge the measured quantity of oil from the measuring transparent container 14 into the fuel tank 38 in which it is readily mixed with the fuel. When all the oil contained in the measuring and proportioning container 14 has been discharged, the switch 44 is returned to its neutral position, which stops the motor 48 and the pump 46, and which deactivates the solenoid 51, thus automatically returning the valve 50 to its position of FIG. 2 thereby disconnecting the discharge pipe or hose 26 from the conduit 52 and reconnecting the conduit 52 to the pipe or hose 24 leading to the oil reservoir 25. This automatically prevents the pump from being connected to the discharge pipe or hose 26, thus preventing fuel fumes or overflow liquid fuel from being drawn by the pump if accidentally started. The pump 46 is therefore continuously connected to the oil reservoir 25, except when it is momentarily connected to the fuel tank filler insert 28 during discharge of the oil contained in the measuring and proportioning container 14.

As previously mentioned, the markings of the graduations 16 on the transparent face of the measuring and proportioning oil container 14 are preferably in galloons of oil rather than in pints, quarts or gallons of oil to simplify the task of a boatsman using a constant ratio of lubricating oil to fuel. However, if so desired, the markings of the graduations 16 may be expressed in volume of lubricating oil, and appropriate tables may be used to determine the appropriate proportional volume of lubricating oil to be used for proper mixing with a given volume of fuel. For example, if a fuel to lubricating oil ratio of 50 to 1 is used, and 200 gallons of fuel are taken into the fuel tank, lubricating oil is drawn into the measuring proportioning tank 14, with the control switch 44 placed in the "fill" mode, until the level of lubricating oil reaches the four gallon level. The control switch 44 is then displaced to its "discharge" mode, until the container 14 is empty, at which time the control switch 44 is returned to its "off" neutral position. During discharge of the lubricating oil, proper function of the valve 50 and of the whole system may be verified by observing the flow of oil through the transparent portion of the pipe or hose 26.

Having thus described the present invention by way of an example of structural embodiment thereof, modifi-cations whereof will be apparent to those skilled in the art, what is claimed as new is as follows:

1. A fuel-lubricating oil proportioner and mixer for discharge into a fuel tank comprising a graduated lubricating oil measuring container, a reversible pump, means for connecting said pump in fluid communication with said measuring container, a lubricating oil reservoir, a two-way valve, first conduit means between said valve and said pump, second conduit means between said oil reservoir and said valve, and third conduit means between said valve and the fuel tank, said two-way valve normally connecting said first and second conduits, manually operable control means for driving said pump in a first direction drawing oil from said oil reservoir through said second conduit means, through said valve and said first conduit means into said measuring container, said manually operable means being operable for reversing said pump and actuating said valve from said normal position for placing said first conduit means in communication with said third conduit means for pumping said measured quantity of lubricating oil from said container to the fuel tank.

2. The fuel-lubricating oil proportioner and mixer of claim 1 wherein said valve normally places said first conduit means in communication with said second conduit means and cuts off said third conduit means when said solenoid is disconnected from said source of electrical power.

3. The fuel-lubricating oil proportioner and mixer of claim 1 wherein said measuring container is graduated in units of volume of lubricating oil.

4. The fuel-lubricating oil proportioner and mixer of claim 1 wherein said measuring container is graduated in units of volume of fuel.

5. The fuel-lubricating oil proportioner and mixer of claim 1 wherein said third conduit means has an end connected to said valve and another end connected to a tubular insert disposed in a fuel filler conduit defining a fuel inlet for said fuel tank.

6. The fuel-lubricating oil proportioner and mixer of claim 1 wherein said third conduit means has a transparent portion providing a visual check of lubricating oil flow therethrough.

7. A fuel-lubricating oil proportioner and mixer for discharge into a fuel tank, comprising:

a temporary storage container;

means for sensing the quantity of fluid in said container and indicating the accumulated quantity at any instant of time;

a fluid reservoir;

means for conveying fluid from said reservoir to said container in a stream flow;

means for initiating and stopping said stream flow to establish a predetermined quantity in said container;

said means for predetermined quantity being operator-determined;

means for conveying fluid from said container to said tank in a stream flow; and mutually exclusive valve means for establishing said flow to or from said container.

8. A fuel-lubricating proportioner and mixer for discharge into a fuel tank, comprising in combination:

a lubricating oil reservoir;

a graduated lubricating oil measuring container;

a reversible pump connected to said measuring container;

two-way valve means;

first conduit means interconnecting said valve means and said pump;

second conduit means interconnecting said oil reservoir and said valve means;

third conduit means interconnecting said valve means and the fuel tank;

means for controlling the position of said valve means enabling said pump to convey a measured quantity of oil from said oil reservoir to said measuring container when said valve means is in a first position and said reversible pump is moving in a first direction and for enabling said pump to convey said measured quantity of oil from said oil reservoir to the fuel tank when said valve means is in a second position and said reversible pump is moving in a second direction.

* * * * *